US005868632A

United States Patent [19]

Drelick

[11] Patent Number: 5,868,632

[45] Date of Patent: Feb. 9, 1999

[54] GOLF CLUB SWING TRAINING DEVICE

[76] Inventor: Teresa M. Drelick, 7 Nelson Ave., Methuen, Mass. 01844

[21] Appl. No.: 393,356

[22] Filed: Feb. 23, 1995

[51] Int. Cl.[6] ..... A63B 69/36

[52] U.S. Cl. ..... 473/213; 473/276

[58] Field of Search ..... 273/189 R, 189 A; 473/212, 213, 276, 214, 205

[56] References Cited

U.S. PATENT DOCUMENTS

| | | | |
|---|---|---|---|
| 3,490,766 | 1/1970 | Gardner | 273/189 A X |
| 3,700,245 | 10/1972 | Nannini | 473/213 |
| 4,070,027 | 1/1978 | Kifferstein et al. | 473/214 |
| 4,088,318 | 5/1978 | Massman | 273/189 A X |
| 5,180,169 | 1/1993 | Choy | 273/189 A |
| 5,324,038 | 6/1994 | Sasser | 273/189 R X |
| 5,395,117 | 3/1995 | Ogden | 273/189 A |
| 5,401,017 | 3/1995 | McDonald et al. | 273/189 R X |
| 5,511,788 | 4/1996 | Manley et al. | 473/212 X |

*Primary Examiner*—George J. Marlo
*Attorney, Agent, or Firm*—George E. Kersey, Esq.

[57] ABSTRACT

A device which indicates a change in the angular position of a golfer's hand during a backswing. The device includes a continuous rod having parallel segments detachably mounted to a wrist encircling support, and the rod is bent to form an arcuate portion extending of an angle with respect to the parallel segments. When the golfer's hand engages the arcuate portion, the commencement of a downstroke is indicated.

5 Claims, 5 Drawing Sheets

FIG. 2A
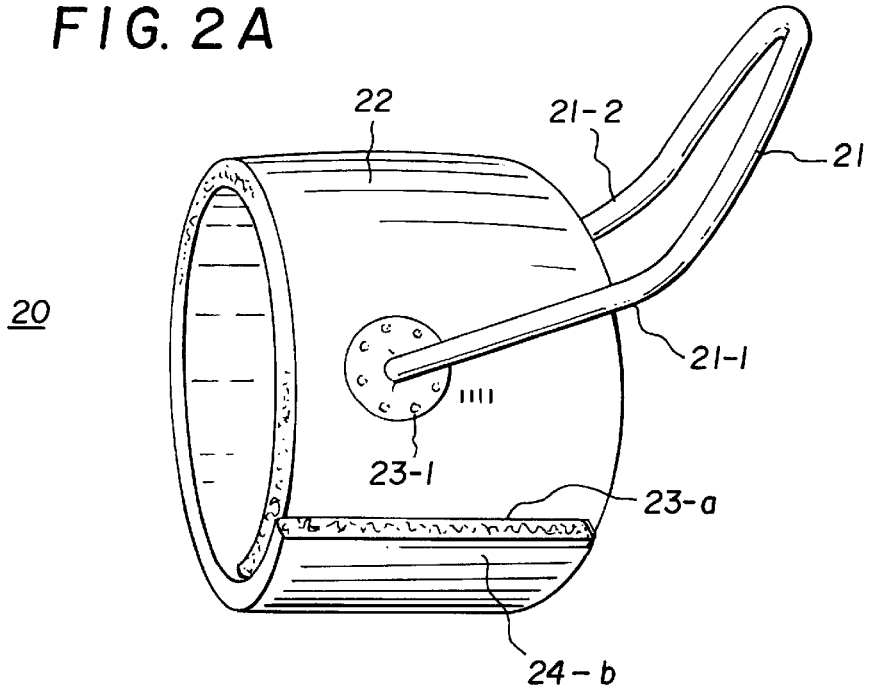
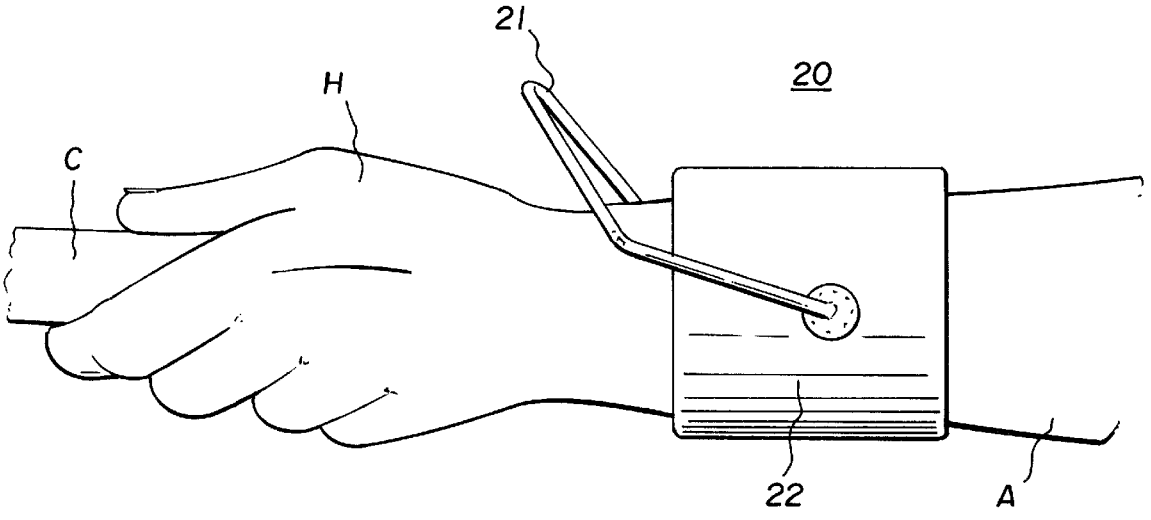
FIG. 2B

GOLF CLUB SWING TRAINING DEVICE

This invention relates to golfing, and more particularly to methods and apparatus for controlling the swings of golfers.

BACKGROUND OF THE INVENTION

There have been numerous procedures and devices for helping golfers improve their swings. Some are illustrated in Austad's Golf Catalogue for "Summer 1994", 4500 East 10th Street, Sioux Falls, S.D. 57196, including a Power Swing Fan which is attached to the shank of the club and uses wind resistance, instead of a heavy weight, to improve swing path technique and strengthen the muscles using in the swing. Another training aid is a golf club with an adjustable hinge which breaks down if the club is swung incorrectly.

Another golf swing aid is disclosed in U.S. Pat. No. 5,330,189 issued Jul. 19, 1994 to James Reichow of Brooklyn Park, Minn. The Reichow golf swing aid is attachable to the shaft of a golf club and includes electrical circuitry with a source of power, a mercury switch and a sound emitting element. This golf swing aid allows a golfer to preset the circuitry, so that upon the backswing of a club, sound will be emitted when the mercury switch is tripped at a prescribed backswing elevation of the club.

The golf swing aid of the Reichow patent has the disadvantage of interfering with the weighting of the club because of its required attachment to the shaft of the club. Moreover, when the device is removed from the club, there is a disturbance in the swing of the player who has come to rely on the presence of the device.

It is generally well known to golfers that one of the most difficult determinations in golf is that of controlling the backswing. In many cases the backswing is either excessive or inadequate with consequent effect upon the shot. Moreover, if the backswing is not correctly oriented, the result can be an undesirable "slice" in which the club head swings across the ball and causes a right-had departure from desired linearity or a "hook" in which the club head strikes the ball in the opposite fashion of the slice and causes a left-hand departure from linearity. In general, judging how much of a backswing to take is one of the most difficult determinations that is to be made in the game of golf.

While there are various golf aid and golf swing aid devices available, they function primarily on a mechanical, centrifugal force basis.

Accordingly, it is an object of the invention to provide a golf swing aid and method that will allow the golfer to improve his swing. A related object is to achieve an improved swing without the need for mechanical devices that requires attachment to the shaft or other portion of the golf club.

A further object of the invention is to provide facility in the use of a golf swing aid that is compact, of light weight and easily used and transported on the golf course.

It is still a further object of the invention to provide a golf swing aid which does not require a mercury-switch controlled electrical circuit.

SUMMARY OF THE INVENTION

In accomplishing the foregoing and related objects, the invention provides for facilitating the control of a golf swing by an indicator for signaling the relationship between a portion of a golfer's body and the golfer's arm during a backswing. The indicator is removably attachable to the golfer.

In accordance with one aspect of the invention the indicator is extendable from the arm of the golfer, and is removably securable to the arm of the golfer by a band containing locking projections on one surface and receptor for engaging the locking projections on an opposite surface. The indicator desirably is weighted to facilitate desired positioning on the arm of the golfer.

The indicator can be formed by a member that is connected to a base containing electronic circuitry, which can extend into the member, which can be detachable from the base and can be mountable angularly upon the base, which can be mounted on an appendage of a golfer by a clamp.

In a method in accordance with the invention for facilitating control over a golf swing, the relationship is indicated between the upper portion of a golfer's body and the golfer's arm during a backswing. The method further can include the preliminary step of removably attaching an indicator to the arm of the golfer.

In accordance with one aspect of the method, the indicator is removably secured to the arm of the golfer using a band containing locking projections on one surface and receptors for engaging the locking projections on an opposite surface. The method can further include the step of weighting the indicator to facilitate desired positioning on the arm of the golfer. The method further includes the step of signaling the golfer when the indicator reaches a prescribed position of the golfer's arm relative to the golfer's body.

In a method in accordance with the invention of constructing apparatus for facilitating the control of a golf swing, provision is made for indicating the relationship between the upper portion of a golfer's body and the golfer's arm during a backswing. Provision is also made for attaching the indicator to the golfer, for example, by a band containing locking projections on one surface and receptor for engaging the locking projections on an opposite surface. The indicator can be weighted to facilitate the desired positioning on the arm of the golfer.

The method can further include the step of incorporating electronic circuitry in the indicator, which can be detachably mountable perpendicularly upon a base.

DESCRIPTION OF THE DRAWINGS

Other aspects of the invention will become apparent after considering several illustrative embodiments, taken in conjunction with the drawings in which:

FIG. 2A is a fragmentary enlargement of FIG. 1A showing applicant's golf swing indicator in greater detail;

FIG. 2B is a diagram showing the golf swing of FIG. 2A indicator on a golfer's arm;

DETAILED DESCRIPTION

Figure 1A:
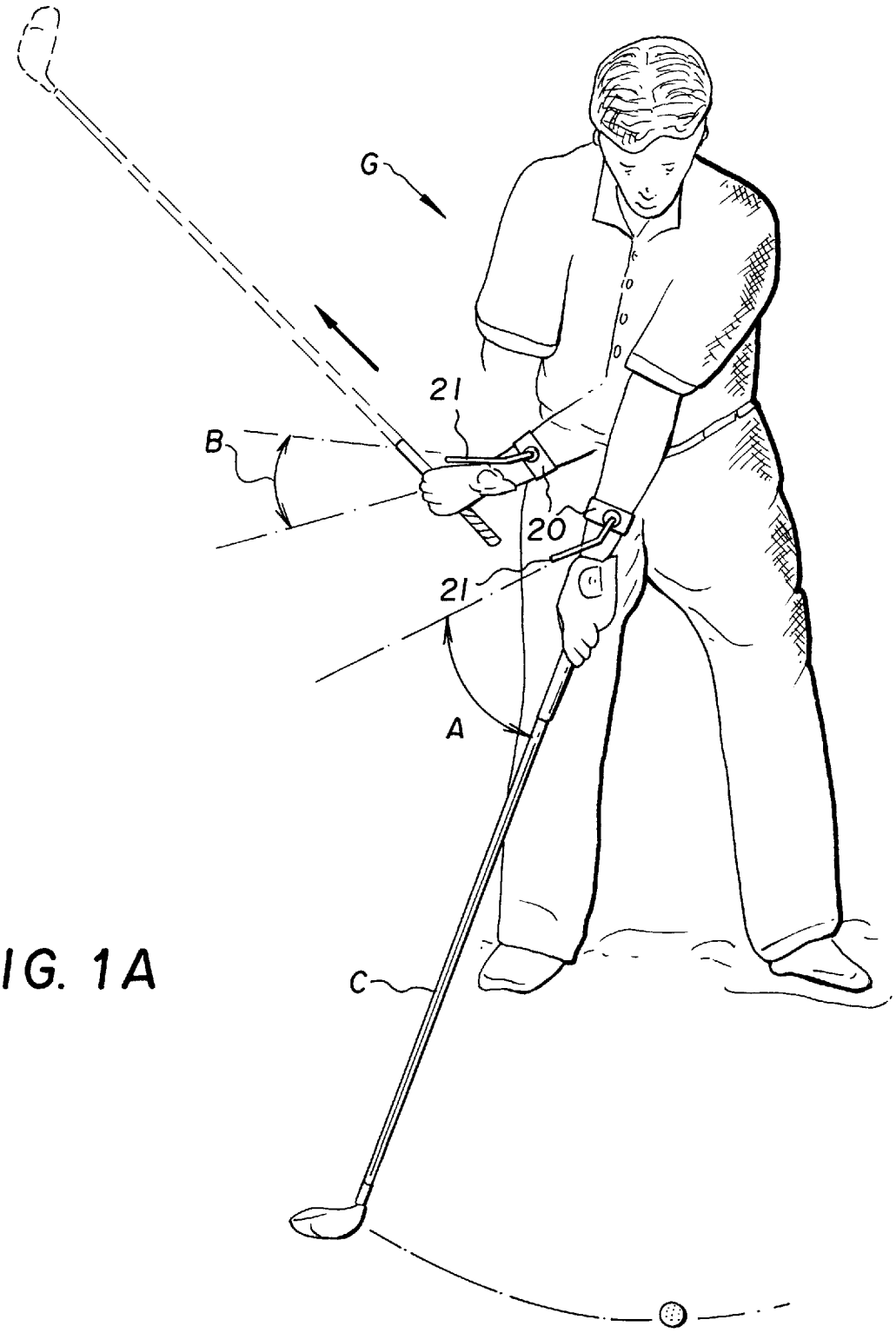
FIG. 1A is a perspective view of a right-handed golfer at the commencement of a backswing using a golf swing indicator in accordance with the invention.

With reference to the drawings, FIG. 1A shows, in perspective, a right-handed golfer G with a club C, using a golf swing indicator assembly 20 in accordance with the invention.

In FIG. 1A the golfer G commences his swing with an indicator rod 21 of the assembly 20 forming an angle A in relation to the axis of the shaft S of the club C, which is reduced to the angle B as the club C is raised during the intitial portion of the backstroke.

Figure 1B:
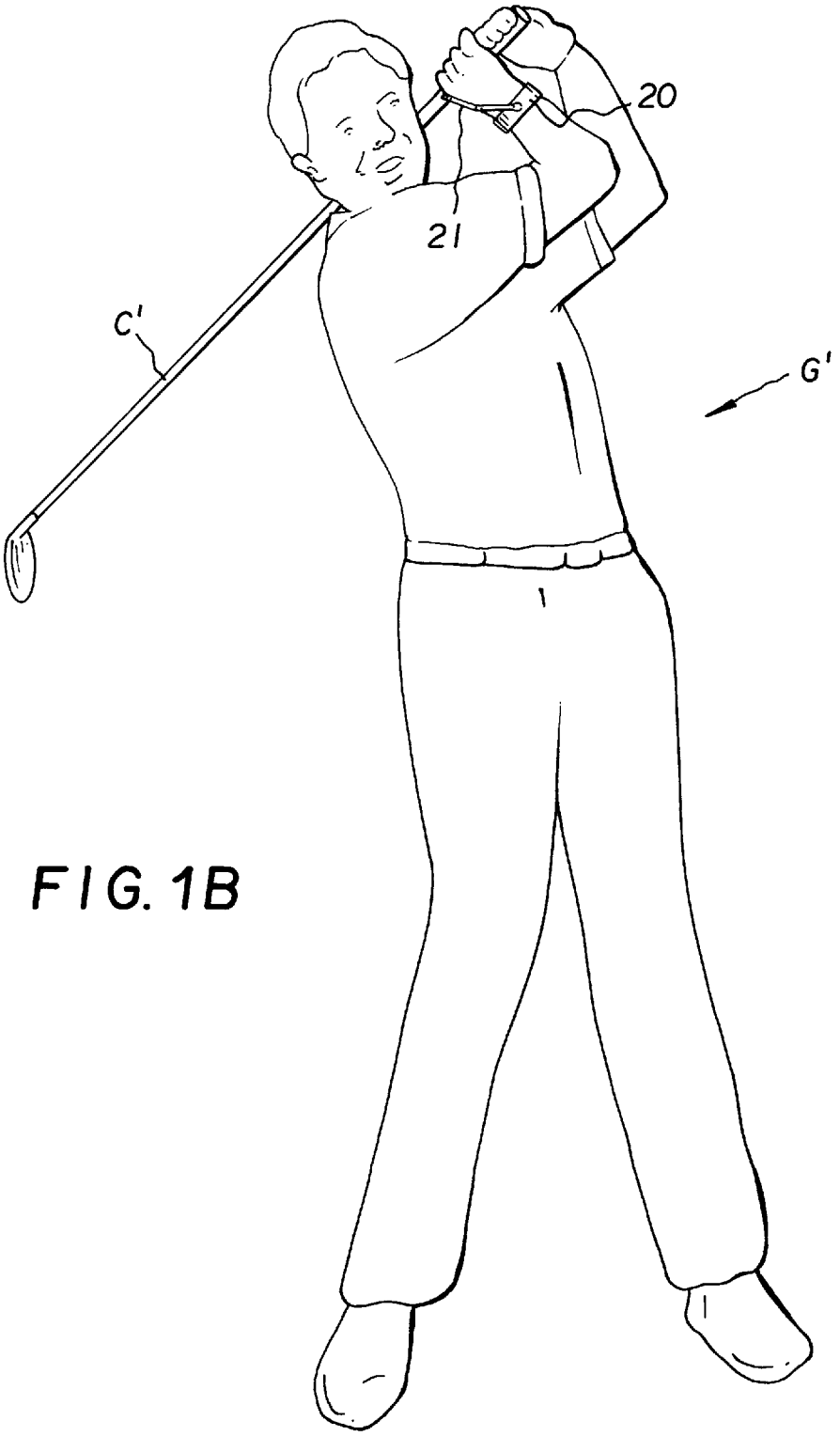
FIG. 1B is a perspective view of a left-handed golfer at the top of a backswing using a golf swing indicator in accordance with the invention.

In the final position of a proper backstroke, as shown for the left-handed golfer G' of FIG. 1B, the rod 21 is in contact with the hand H' of the Golfer G', indicating that the golfer G' is ready to commence his downward stoke for engaging the golf ball.

Figure 2C:
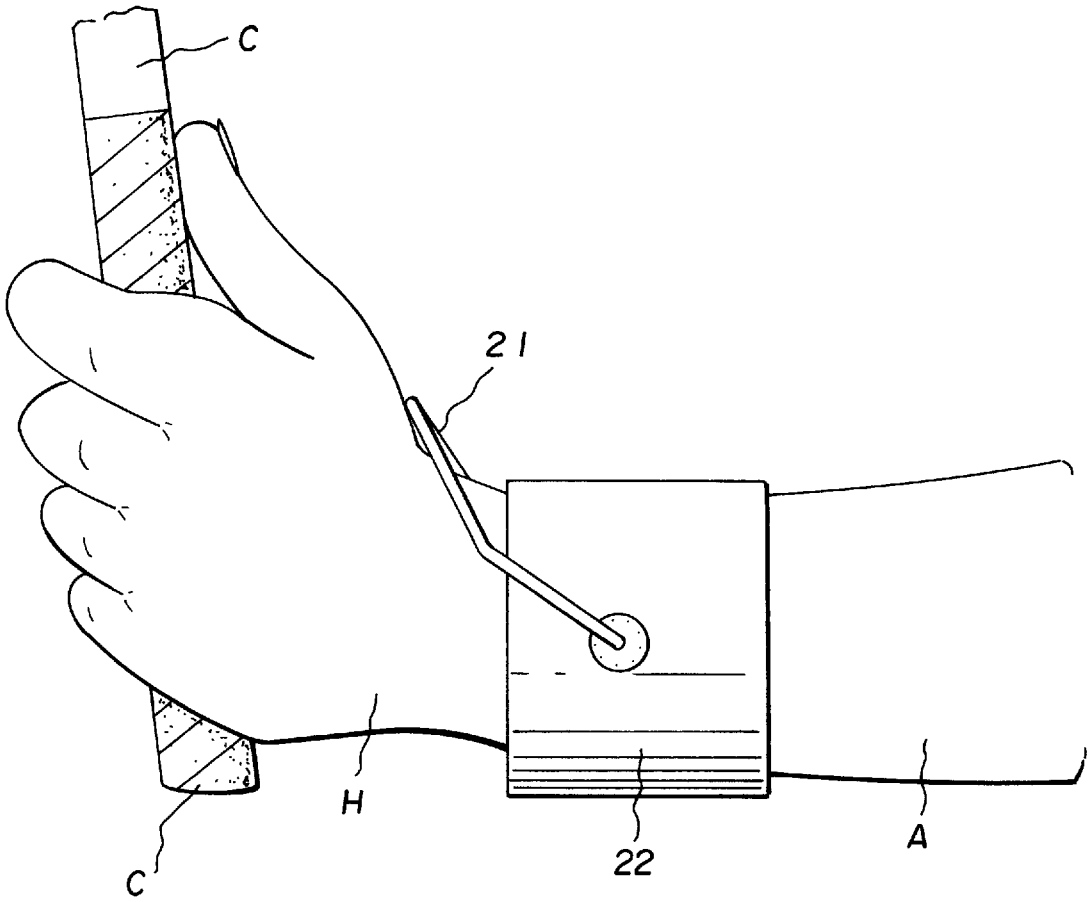
FIG. 2C is a diagram showing applicant's the golf swing indicator of FIG. 2B in contact with the golfer's hand in accordance with the invention.

The assembly 20 is formed, as shown in greater detail in FIG. 2A, by a rod 21 and a base 22. By contrast with conventional golf swing aids, which are mounted on the shaft of the golf club C, the indicator 20 is mounted on the arm A of the golfer G. Consequently, the invention avoids the disadvantages associated with the weighting of the golf club shaft.

In FIG. 1A, the golfer G is at the beginning of a backstroke, which proceeds from the initial position of FIG. 1A in the arcuate direction indicated by the dashed-line arrows.

In order to reach the proper end for the backstroke, the indicator 20 comes into contact with the hand H' of the golfer G' as shown in FIG. 1B. It is this contact that signals the golfer G' that his club C' has reached the proper position for the commencement of the subsequent downstroke (not shown).

As illustrated in FIG. 2A, the indicator 20 is formed from two principal elements, the rod 21 and a base 22. The base 22 can form a weighted mount for the rod 21. Additional weighting may be included if desired. The weighting of the base 22 can provide stability for the indicator 20 on the arm of the golfer G or G'.

In addition, the rod 21 can be detachable from the base 22. In the embodiment of FIG. 2A, the rod 21 exerts spring tension against ports 23-1 and 23-2 in the base 22, so that detachment is achieved by moving the legs 21-1 and 21-2 of the rod 21 away from one another.

The indicator 20 is held on the arm of the golfer G or G' in any suitable manner, for example, by a band with an underside 23-*a* containing locking projections and upperside with receptors. 24-*b* for engaging the locking projections on an opposite surface. A suitable band for this purpose can be provided by interlocking materials sold and marketed under the trade name "Velcro", but other forms of clamping are suitable as well.

Figure 3A:
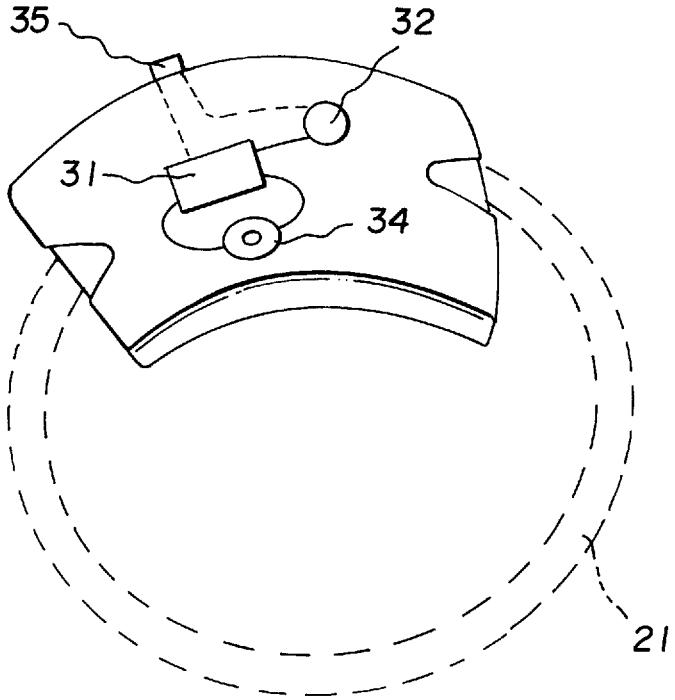
FIG. 3A is a schematic view illustrating electronic circuitry for the indicator of FIGS. 2A–2C.

While the signaling to the golfer that the rod 21 had reached his hand can be by touch, it also is possible to provide an audible alarm. For that purpose the base 22 includes, as illustrated in FIG. 3A, circuitry 30 mounted on a curved substrate 31, including a microchip 32, a "pill" battery and speaker 34 of the kind commonly found in electronic watches. In a addition the rod 21 can serve as a dielectric to provide changed capacitance to the microchip 32 when in close proximity to the hand. This energizes the speaker 34 when the rod 21 approaches the hand of the golfer.

It will be appreciated that other forms of signaling can be provided. Thus spring elements (not shown) can be arranged to apply closure spring force for clamping the indicator 20 to the body of the golfer G.

The base 22 can house other electrical circuit elements, in addition to the power source 33 and the sound emitting element (speaker) 34. Besides an "on-off" switch 35, a mercury or other switch can provide circuit control.

Such a switch can be positioned so that backswing of the club will result in tripping and cause the emission of sound, so that the golfer will stop his backswing and bring the club forwardly to strike the ball.

Figure 3B:
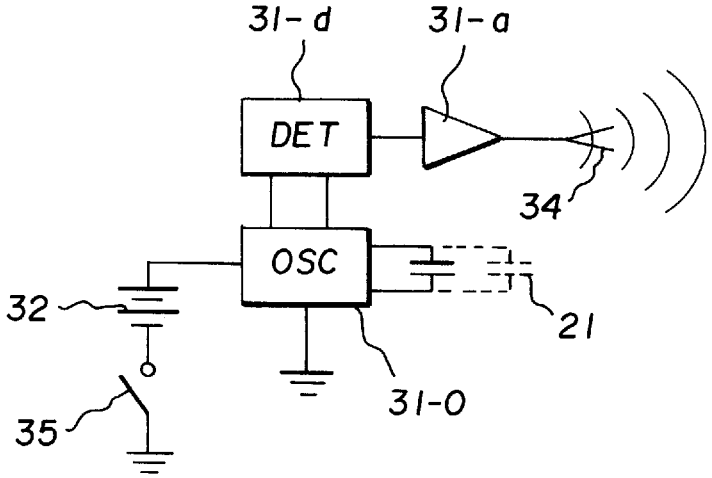
FIG. 3B is a schematic view illustrating electronic components for the indicator of FIGS. 2A–2C.

Typical electrical circuitry, as shown in FIG. 3B, has a power source, in the form of a battery, with one pole connected directly to a sound emitting element, and the other pole of the circuit including a connection through a switch, so that closure will cause sound emission.

It will be understood that the foregoing detailed description is illustrative only, and that other aspects and adaptations of the invention will be apparent to those of ordinary skill in the art, within the scope of the appended claims. The invention provides for the development and control of backswing which is the precursor for a forward, ball driving swing which can impart a desired driving force to the ball.

What is claimed is:

1. Apparatus for facilitating the control of a golf swing, comprising means for indicating a change in the angular position of a golfer's hand during a backswing;

means for attaching said indicating means to the arm of a golfer at a location thereon where the bending of said hand during a backswing can cause said hand to engage said indicating means; said indicating means comprising a continuous rod having parallel segments mounted to said attaching means and forming an arc extending at an angle with respect to said parallel segments.

2. Apparatus as defined in claim 1 wherein said rod is detachable from said base.

3. Apparatus as defined in claim 1 wherein said attaching means is removably securable to said arm of said golfer by a band containing outer locking projections on one surface and receptors for engaging said locking projections on an opposite inner surface.

4. Apparatus as defined in claim 1 wherein said attaching means is weighted to facilitate desired positioning on the arm of said golfer.

5. Apparatus as defined in claim 1 wherein said parallel segment are detachable from said base and exerts spring tension against ports provided in said base, so that detachment is achieved by moving said legs of said rod away from one another.

* * * * *